US011700892B1

(12) United States Patent
Sun et al.

(10) Patent No.: US 11,700,892 B1
(45) Date of Patent: Jul. 18, 2023

(54) PRECISE TEMPERATURE CONTROL DEVICE AND METHOD FOR FLUID CIRCULATION UNIT

(71) Applicant: Shenzhen Compcooler Technology Development Co., Ltd., Shenzhen (CN)

(72) Inventors: Zhengjun Sun, Shenzhen (CN); Qiumao Zhuang, Shenzhen (CN); Zhou Sun, Shenzhen (CN)

(73) Assignee: Shenzhen Compcooler Technology Development Co., Ltd., Shenzhen (CN)

( * ) Notice: Subject to any disclaimer, the term of this patent is extended or adjusted under 35 U.S.C. 154(b) by 0 days.

(21) Appl. No.: 17/975,630

(22) Filed: Oct. 28, 2022

(51) Int. Cl.
*A41D 13/005* (2006.01)
*G08B 5/36* (2006.01)
*A41D 1/04* (2006.01)

(52) U.S. Cl.
CPC ..... *A41D 13/0053* (2013.01); *A41D 1/04* (2013.01); *G08B 5/36* (2013.01); *F25D 2400/26* (2013.01)

(58) Field of Classification Search
CPC ..... G08B 5/36; A41D 13/0053; A41D 1/04; F25D 2400/26
See application file for complete search history.

(56) References Cited

U.S. PATENT DOCUMENTS

2006/0191063 A1* 8/2006 Elkins ..... A62B 17/005 2/458
2017/0321913 A1 11/2017 Dinnage et al.
2019/0101300 A1 4/2019 Dinnage et al.
2020/0037823 A1 2/2020 Pensak

* cited by examiner

*Primary Examiner* — Cassey D Bauer
(74) *Attorney, Agent, or Firm* — Zhigang Ma

(57) ABSTRACT

The present disclosure discloses a precise temperature control device and method for a fluid circulation unit. The device includes a temperature controller, a cold source container, and a liquid cooling vest. The temperature controller includes a shell. a water tank, a first water pump, a second water pump, and a main control panel. The first water pump is connected to the cold source container and the water tank. The second water pump is connected to the water tank and the liquid cooling vest. The liquid cooling vest is connected to the cold source container and the water tank. The water tank is provided with a temperature sensor. The main control panel is electrically connected to an operation apparatus.

9 Claims, 10 Drawing Sheets

PRECISE TEMPERATURE CONTROL DEVICE AND METHOD FOR FLUID CIRCULATION UNIT

TECHNICAL FIELD

The present disclosure relates to the field of temperature adjustment and heat exchange technologies for a water circulation unit, in particular to a precise temperature control device and method for a fluid circulation unit.

BACKGROUND

It is well known that in a high temperature environment, human physiological functions will be abnormal or change. For example, sweating a lot will increase a cardiovascular load. A slight rise in body temperature will affect the concentration and judgment of a user, resulting in irritability and unstable physical conditions. A serious rise in body temperature will cause heatstroke, which will cause thermoplegia and even sudden death if it is not relieved in time. Therefore, developing a device or clothing that can solve the problems in human work and life in a high-temperature environment has become one of the difficulties that need to be solved by global researchers.

With the trend of global warming, the ambient temperature gets higher in summer, but outdoor or high-temperature work is not canceled due to the change of the ambient temperature. Before human body cooling systems are introduced to the market, people in these work places have to endure the high temperature and challenge the limit of tolerance to high temperatures. However, high-intensity work tasks or long-term suffering from a high ambient temperature will cause permanent and irreversible heat damage to people. Under current medical conditions, there are no quick cooling rescue measures after a person gets heatstroke. A weak person has a great possibility of sudden death if the person is not effectively relieved from the heatstroke.

A fluid circulation unit (i.e. liquid cooling vest) is a vital sign device for maintaining a healthy body temperature in hot environments and harsh climates, so that users can work and live normally. A liquid cooling system of the fluid circulation unit adopts a water circulation cooling principle of the aerospace military industry. A water circulation device is connected to the vest. The liquid cooling vest is worn inside. Cooling liquid exchanges heat with a user through continuous circulation to take away the heat generated by the body of the user. The circulating liquid with an increased temperature in the liquid cooling vest flows back to the cooling system for a new round of cooling, and so on, thus keeping the body temperature of the user constant and comfortable and making the user focus more on efficient work and life.

However, in the existing fluid circulation unit, a cryogenic ice-water mixture is directly injected to the liquid cooling vest for cooling. The temperature of the ice-water mixed liquid is generally 1-5 degrees. This cooling mode is suitable for high temperature environments. This suit worn on a healthy user can quickly take away the heat generated by the body of the user, and achieve fast cooling. If a user wears this suit for along time in a non-ultrahigh-temperature environment, the body will be easily in an undercooling status. A weak user will feel uncomfortable if the body is in the undercooling status for a long time. At the same time, the cryogenic circulating liquid is directly injected into the liquid cooling vest. Since the liquid cooling vest will exchange heat with the environment, an extremely large temperature difference will aggravate the heat exchange with the environment, leading to rapid loss of cold. The cold cannot fully act on the user, thus reducing the service time of a cold source. For users in some specific places, due to the physical functions, they need to set their own temperatures and ensure precise temperature control of the liquid circulation, so as to keep the temperature of the liquid cooling vest to maintain the human body heat exchange efficiency and maintain the best body comfort. The traditional cryogenic liquid circulation of the direct ice-water mixture cannot meet the requirements.

Therefore, a precise temperature control device and method for a fluid circulation unit is provided to solve the above problems.

SUMMARY

For the shortcomings in the prior art, the present disclosure aims to provide a precise temperature control device and method for a fluid circulation unit.

In order to achieve the foregoing purpose, the present disclosure adopts the following technical solution:

A precise temperature control device for a fluid circulation unit includes a temperature controller, a cold source container, and a liquid cooling vest for water circulation heat exchange, wherein the temperature controller includes a shell, a water tank arranged in the shell, a flow division device with a flow division function, a first water pump, a second water pump, and a main control panel; the main control panel is electrically connected to an operation apparatus for setting a temperature; the flow division device is provided with a primary flow division port, a secondary flow division port, and a backflow port which are interconnected; a water inlet of the first water pump is connected to the cold source container through a first pipeline, and a water outlet is connected to the water tank through a second pipeline; a water inlet of the second water pump is connected to the water tank through a third pipeline, and a water outlet is connected to a water inlet of the liquid cooling vest through a fourth pipeline; a water outlet of the liquid cooling vest is connected to the water tank through a fifth pipeline, the primary flow division port and the secondary flow division port of the flow division device and a sixth pipeline in sequence; the backflow port of the flow division device is connected to the cold source container through a seventh pipeline; the water tank is provided with a temperature sensor; the temperature sensor, the first water pump and the second water pump are electrically connected to the main control panel; the water tank is filled with liquid; the temperature controller forms a cold-heat adjustable circulating water path with the cold source container and the liquid cooling vest through pipelines; and the main control panel is connected to a power supply and controls the system to work in order.

Preferably, the main control panel is provided with a micro control unit (MCU) chip, a first drive circuit, and a second drive circuit; the operation apparatus is internally provided with an auxiliary control panel; the power supply supplies power to the MCU chip; the auxiliary control panel is provided with a display device, a nixie tube drive chip, and several buttons for operation; the MCU chip sends a signal and drives the first water pump and the second water pump to rotate and run through the first drive circuit and the second drive circuit respectively; the temperature sensor is electrically connected to the MCU chip and uploads a measured temperature signal of the water tank to the MCU chip; the nixie tube drive chip is electrically connected to a first indicator lamp circuit and a second indicator lamp circuit; a circuit and button of the display device are electrically connected to the nixie tube drive chip respectively; the MCU chip is electrically connected to a third indicator circuit; the MCU chip outputs different voltage values through the first drive circuit and the second drive circuit in a manner of converting a digital signal to an analog signal, and drives the first water pump and the second water pump to generate different rotation speeds; a user sets a temperature required by the liquid cooling vest through the button and drives the display device to implement displaying through the nixie tube drive chip; the MCU chip determines the rotation speed of the first water pump according to a difference value between a set temperature and an actual temperature of liquid in the water tank; when the actual temperature of the liquid in the water tank is the same as the set temperature, the first water pump rotates at a reduced speed, and the second water pump rotates and runs at a constant speed and pumps the liquid from the water tank to the circulating water path in the liquid cooling vest.

Preferably, the cold source container is a bag body or a thermal insulation case body internally provided with a cold source body, and the cold source body is ice.

Preferably, outer surfaces or inner walls of the water tank, the first pipeline, the second pipeline, the third pipeline, the fourth pipeline, the fifth pipeline, the sixth pipeline, the seventh pipeline and the cold source container are all provided with thermal insulation layers.

Preferably, the first water pump is a centrifugal pump, and the second water pump is a diaphragm pump.

Preferably, an inner diameter of the backflow port of the flow division device is smaller than the inner diameters of the primary flow division port and the secondary flow division port.

Preferably, the MCU chip is chip PIC16F1825, and the nixie tube drive chip is chip TM1650.

Preferably, the main control panel is provided with a communication interface for connecting a Bluetooth module, a WiFi module and an external human vital sign monitoring module.

A precise temperature control method for the fluid circulation unit includes the following steps:

S1. a user wears the liquid cooling vest, and presets a desired temperature of the liquid cooling vest using the operation apparatus, and at the same time, the temperature sensor transmits an actual temperature signal of the liquid in the water tank to the main control panel;

S2. the first water pump pumps cryogenic liquid out from the cold source container through the first pipeline to the water tank, thereby reducing the temperature of the liquid in the water tank; the main control panel determines a numerical value of the rotation speed of the first water pump according to a difference value between the temperature preset by the operation apparatus and the actual temperature of the liquid in the water tank, and the difference value in the temperature is in direct proportion to the rotation speed of the first water pump;

S3. when the actual temperature, measured by the temperature sensor, of the liquid in the water tank reaches the temperature preset by the operation apparatus, the main control panel controls the first water pump to run at a low speed, and the main control panel controls the second water pump to run at a constant speed and pumps the cryogenic liquid from the water tank to the circulating water path in the liquid cooling vest;

S4. the liquid in the circulating water path in the liquid cooling vest contacts heat of the body of the user to achieve a temperature rise in the liquid in the circulating water path in the liquid cooling vest, and at the same time, the liquid in the circulating water path in the liquid cooling vest flows back to the water tank through the fifth pipeline, the flow division device and the sixth pipeline;

S5. after the user uses the liquid cooling vest for a period of time, the liquid in the circulating water path of the liquid cooling vest has a temperature rise and flows back to the water tank, so that the temperature of the liquid in the water tank rises; the main control panel may control the rotation speed of the first water pump according to the difference value between the temperature preset by the operation apparatus and an actual temperature rise or drop of the liquid in the water tank; steps S2 and S3 are repeated until the temperature of the liquid in the water tank reaches the preset temperature of the operation apparatus, so that the second water pump pumps the constant-temperature liquid from the water tank to the circulating water path in the liquid cooling vest to keep the liquid in the circulating water path in the liquid cooling vest constant.

By the adoption of the above solution, the temperature controller of the present disclosure forms the cold-heat adjustable circulating water path with the cold source container and the liquid cooling vest through the pipelines. The main control panel is connected to the power supply and controls the system to work in order and the operation apparatus can preset the temperature of the liquid cooling vest. Therefore, the main control panel can control the rotation speed of the first water pump according to the difference value between the temperature preset by the operation apparatus and the actual temperature of the liquid in the water tank, and then the main control panel can precisely control, through the first water pump, a flow rate of the cryogenic liquid flowing through the cold source container into the water tank. A range of temperature fluctuation of the liquid in the water tank can be precisely controlled by the main control panel. When the actual temperature, measured by the temperature sensor, of the liquid in the water tank is the same as the temperature set by the operation apparatus, the main control panel controls the first water pump to run at a low speed, and the main control panel controls the second water pump to run at a constant speed, so that the second water pump pumps the constant-temperature liquid from the water tank to the circulating water path in the liquid cooling vest. Therefore, precise temperature control of the liquid in the circulating water path in the liquid cooling vest is achieved by precisely controlling the temperature of the liquid in the water tank. Therefore, the temperature control precision in the liquid cooling vest is greatly improved. A user feels very comfortable when wearing the vest, and the user can focus more on efficient work and life. Meanwhile, the entire device has a simple working principle and low use cost, works reliably, and greatly meets actual use needs of the user. The device has a simple structure, is convenient to operate, and has extremely high practicability.

DETAILED DESCRIPTION OF THE EMBODIMENTS

Figure 1:
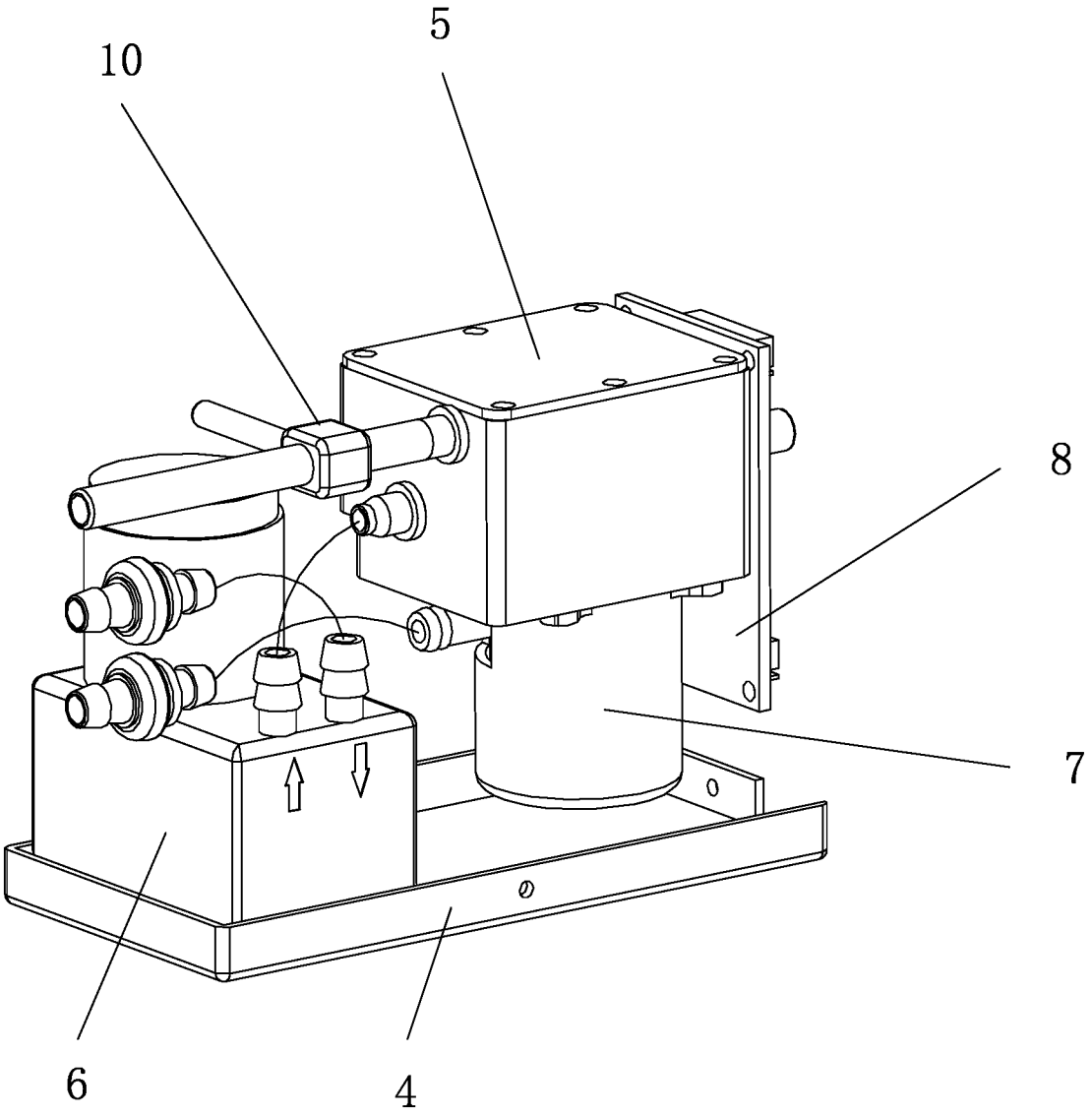
FIG. 1 is a schematic structural diagram of a temperature controller according to an embodiment of the present disclosure.
Figure 2:
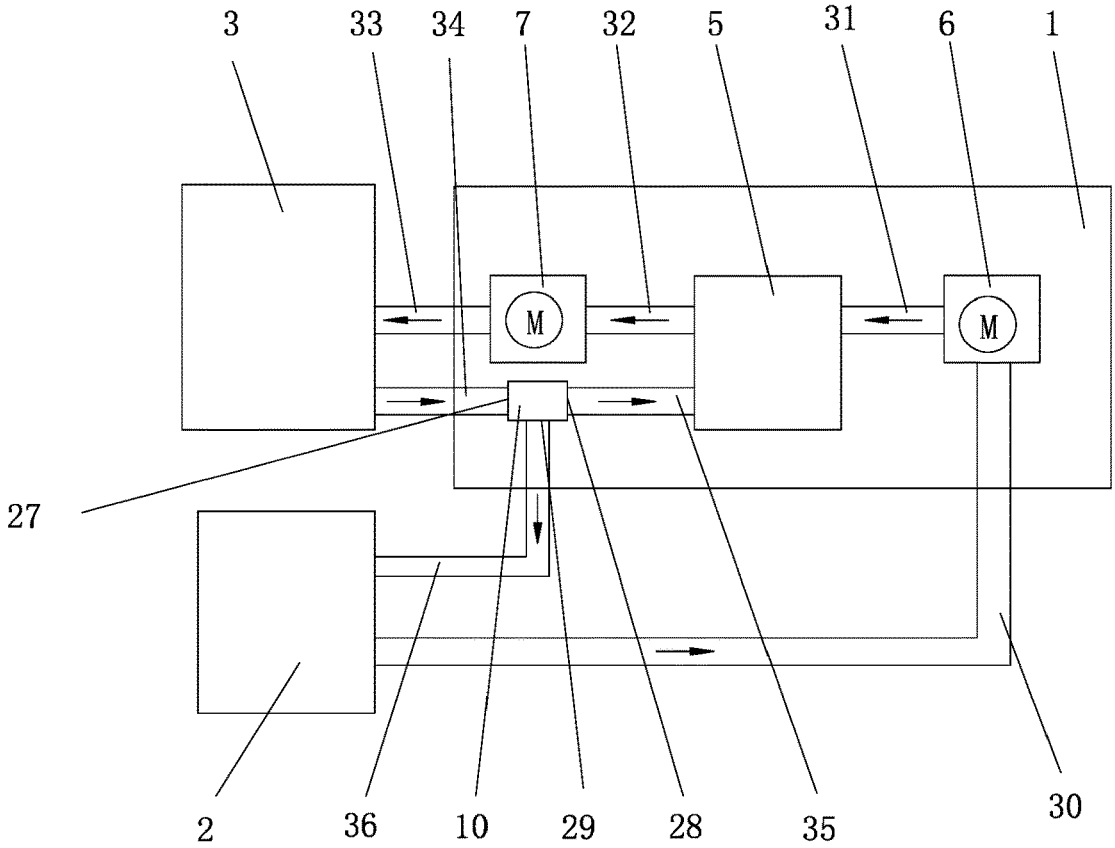
FIG. 2 is a diagram of a liquid path according to an embodiment of the present disclosure.

The embodiments of the present disclosure are described in detail below in combination with accompanying drawings. However, the present disclosure can be implemented in various different ways defined and covered by the claims.

As shown in FIG. 1 to FIG. 11, a precise temperature control device for a fluid circulation unit provided by this embodiment includes a temperature controller 1, a cold source container 2, and a liquid cooling vest 3 for water circulation heat exchange. The temperature controller 1 includes a shell 4, a water tank 5 arranged in the shell 4, a flow division device 10 with a flow division function, a first water pump 6, a second water pump 7, and a main control panel 8. The main control panel 8 is electrically connected to an operation apparatus 12 for setting a temperature. The flow division device 10 is provided with a primary flow division port 27, a secondary flow division port 28, and a backflow port 29 which are interconnected. A water inlet of the first water pump 6 is connected to the cold source container 2 through a first pipeline 30, and a water outlet is connected to the water tank 5 through a second pipeline 31. A water inlet of the second water pump 7 is connected to the water tank 5 through a third pipeline 32, and a water outlet is connected to a water inlet of the liquid cooling vest 3 through a fourth pipeline 33. A water outlet of the liquid cooling vest 3 is connected to the water tank 5 through a fifth pipeline 34, the primary flow division port 27 and the secondary flow division port 28 of the flow division device 10 and a sixth pipeline 35 in sequence. The backflow port 29 of the flow division device 10 is connected to the cold source container 2 through a seventh pipeline 36. The water tank 5 is provided with a temperature sensor 11. The temperature sensor 11, the first water pump 6 and the second water pump 7 are electrically connected to the main control panel 8. The water tank 5 is filled with liquid. The temperature controller 1 forms a cold-heat adjustable circulating water path 14 with the cold source container 2 and the liquid cooling vest 3 through pipelines. The main control panel 8 is connected to a power supply 15 and controls the system to work in order.

Therefore, the main control panel 8 can control the rotation speed of the first water pump 6 according to a difference value between a temperature preset by the operation apparatus 12 and an actual temperature of the liquid in the water tank 5. First, the liquid from the water outlet of the second water pump 7 enters the water tank 5 through the fourth pipeline 33, the liquid cooling vest 3, the fifth pipeline 34, the primary flow division port 27 and the secondary flow division port 28 in sequence. Then, the liquid in the water tank 5 enters the water inlet of the second water pump 7 through the fourth pipeline 33 to form one circulating water path 14. Meanwhile, the water inlet of the first water pump 6 pumps the liquid from the backflow port 29 through the seventh pipeline 36, the cold source container 2 and the fourth pipeline 33 in sequence. The water outlet of the first water pump 6 injects the liquid into the water tank 5 through the second pipeline 31 to form another circulating water path 14. Therefore, the main control panel 8 can precisely control a flow rate of the cryogenic liquid flowing through the cold source contain 2 into the water tank 5 through the first water pump 6. A range of temperature fluctuation of the liquid in the water tank 5 can be precisely controlled using the main control panel 8. The cryogenic liquid with a constant temperature pumped by the second water pump 7 from the water tank 5 to the circulating water path 14 in the liquid cooling vest 3 is constant-temperature liquid with a temperature preset by the operation apparatus 12, so that precise temperature control of the liquid in the circulating water path 14 in the liquid cooling vest 3 is achieved by precisely controlling the temperature of the liquid in the water tank 5. Therefore, the temperature control precision in the liquid cooling vest 3 is greatly improved. A user wearing the liquid cooling vest 3 feels little temperature change and very comfortable, and actual use needs of the user are met.

Figure 3:
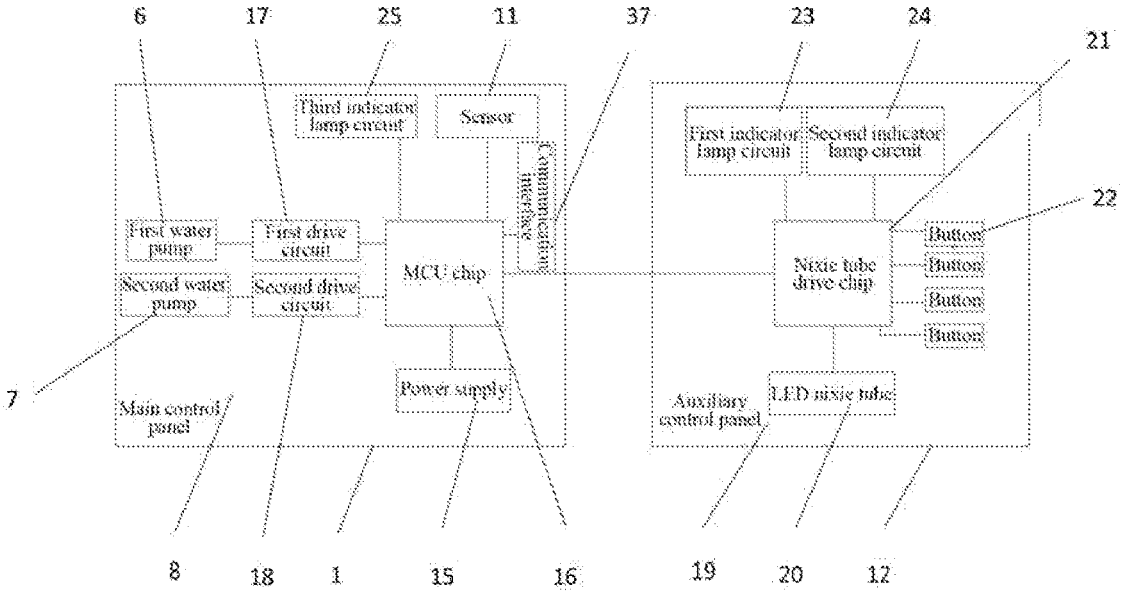
FIG. 3 is a principle diagram of a circuit according to an embodiment of the present disclosure.
Figure 4:
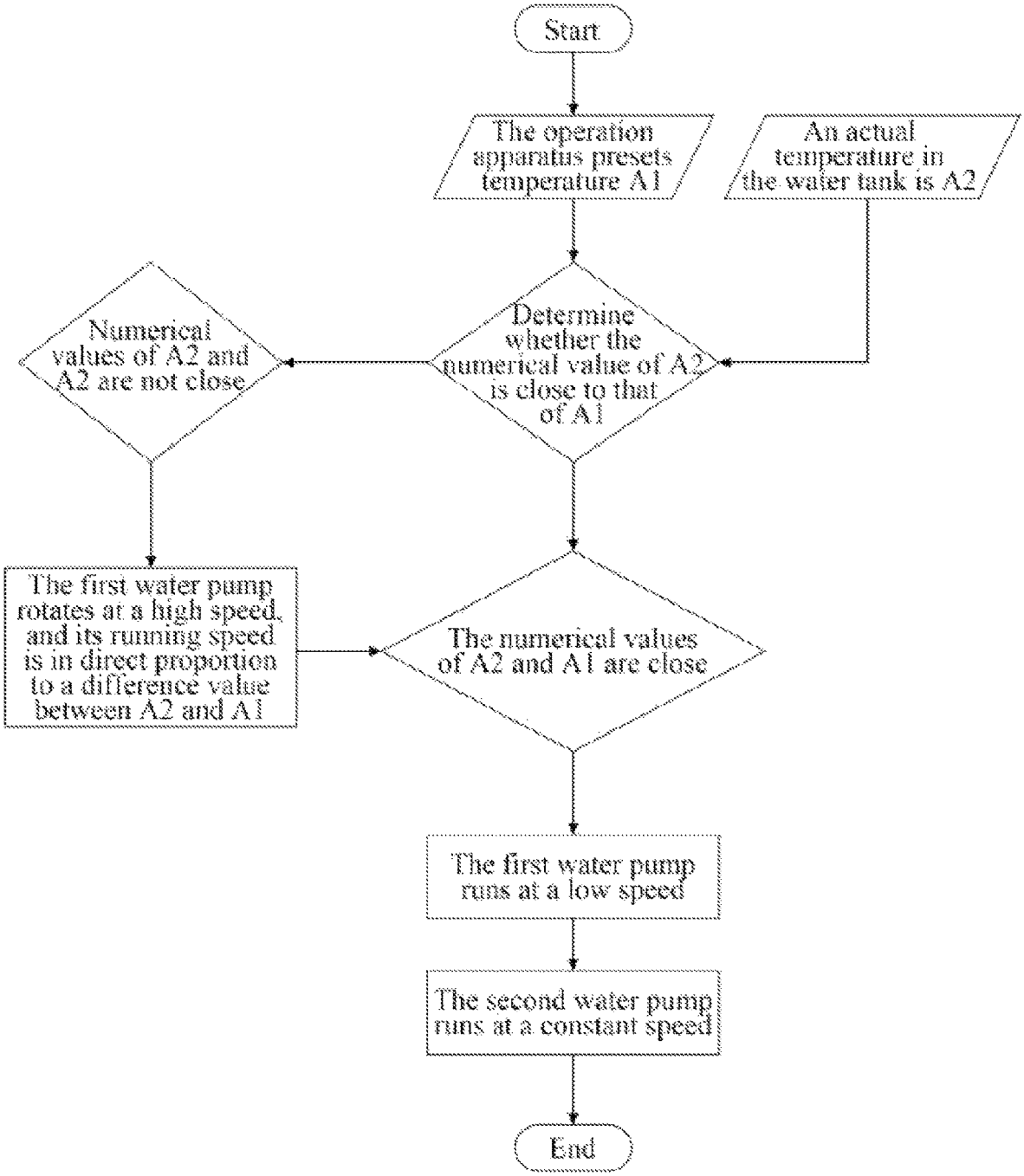
FIG. 4 is a flow chart of an embodiment of the present disclosure.
Figure 5:
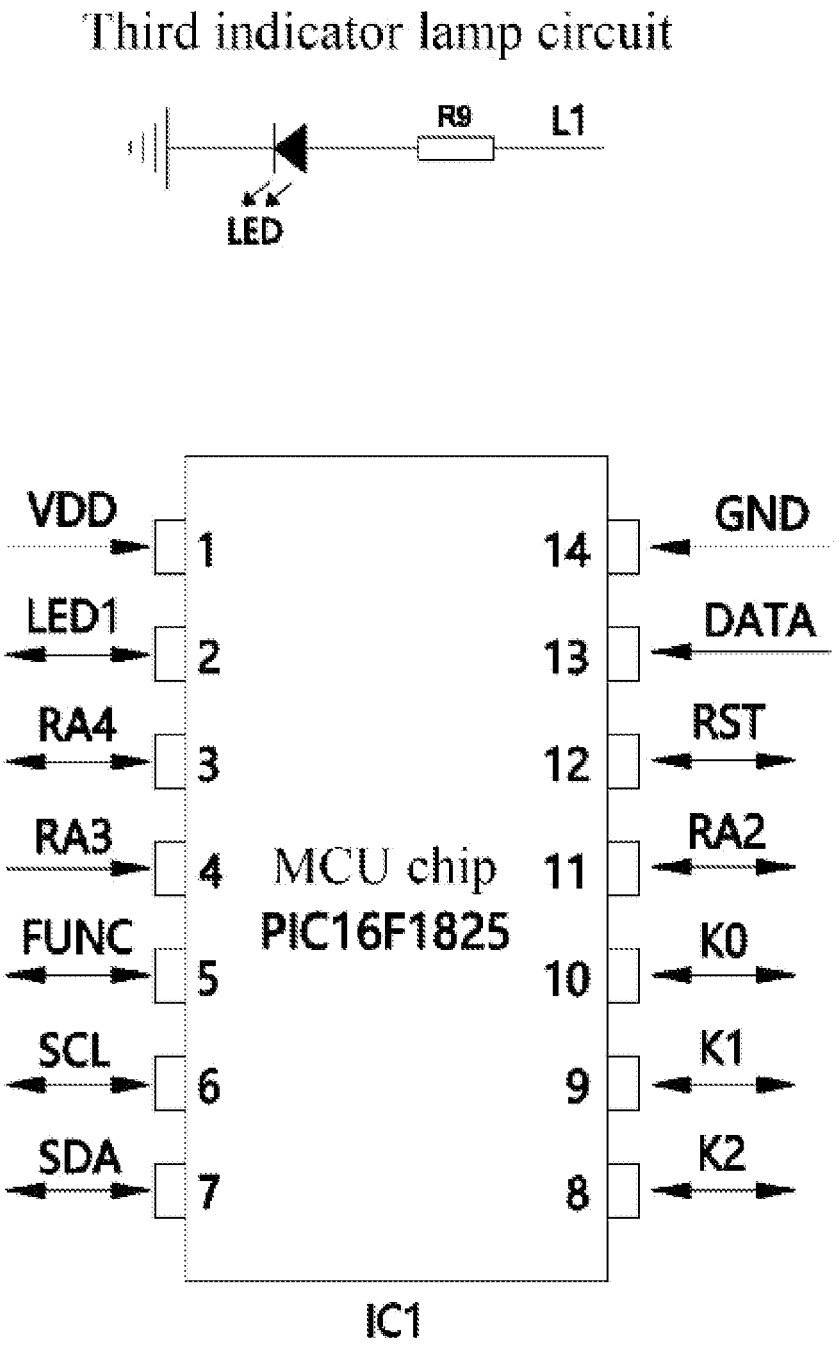
FIG. 5 is a circuit diagram of an MCU chip and a third indicator lamp circuit according to an embodiment of the present disclosure.
Figure 7:
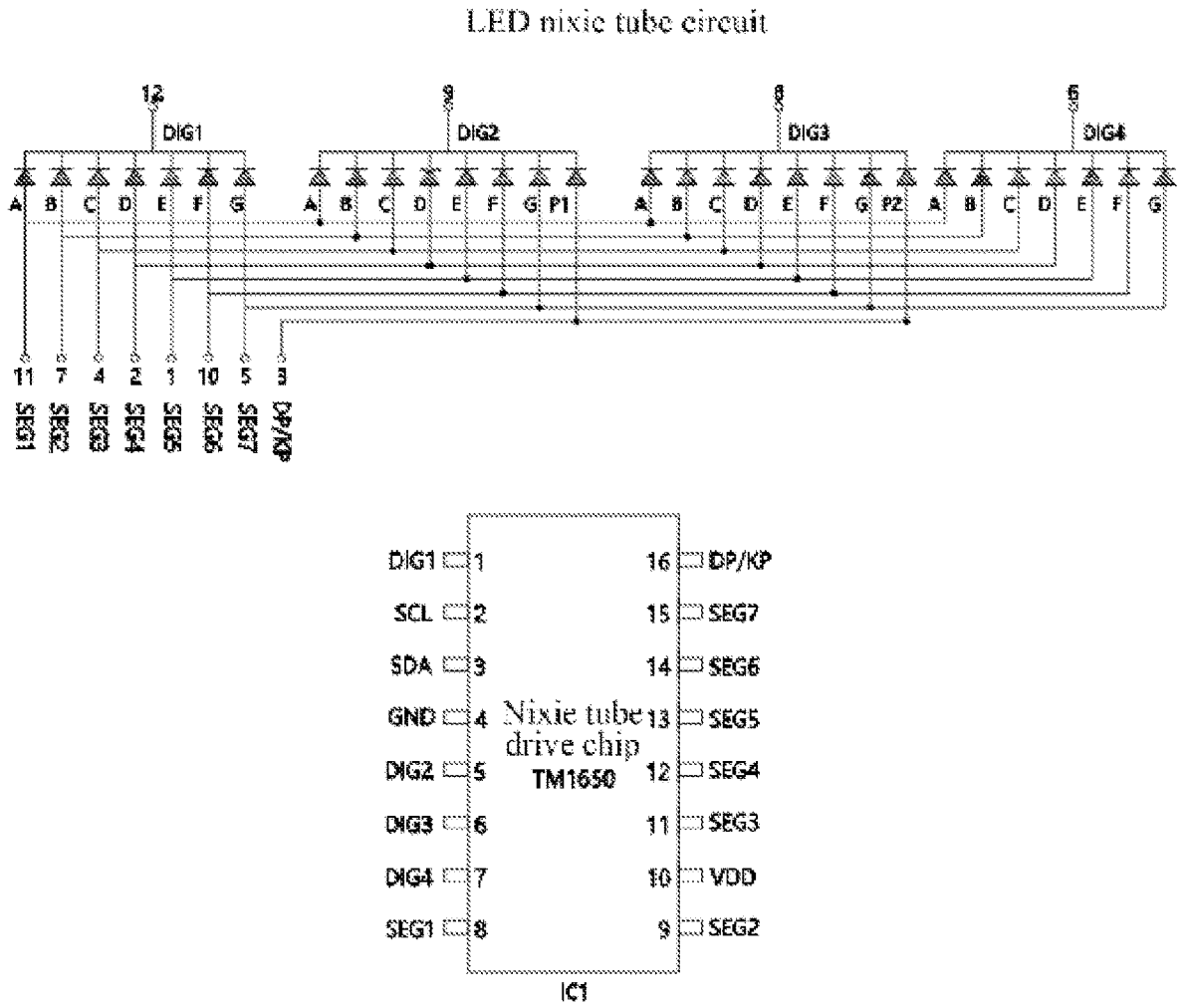
FIG. 7 is a circuit diagram of a nixie tube drive chip and a display device according to embodiment of the present disclosure.
Figure 8:
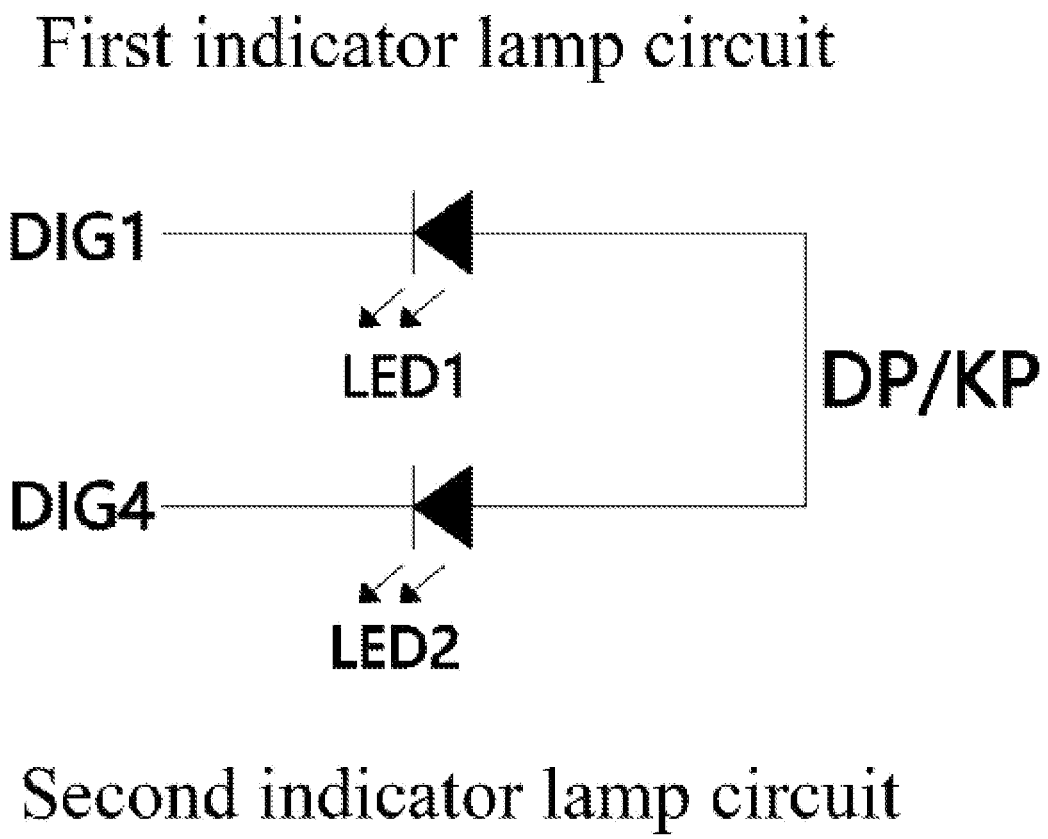
FIG. 8 is a circuit diagram of a first indicator lamp circuit and a second indicator lamp circuit according to an embodiment of the present disclosure.
Figure 9:
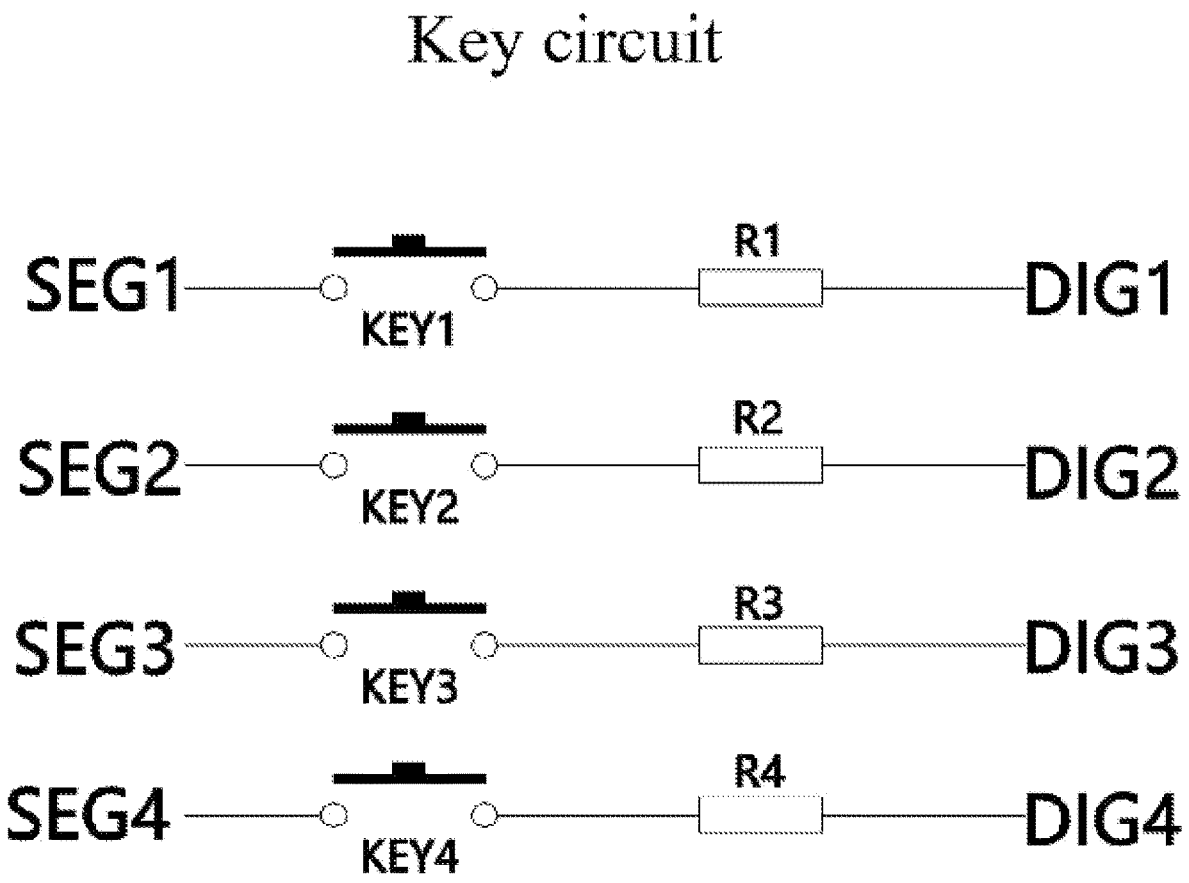
FIG. 9 is a circuit diagram of a button according to an embodiment of the present disclosure.
Figure 10:
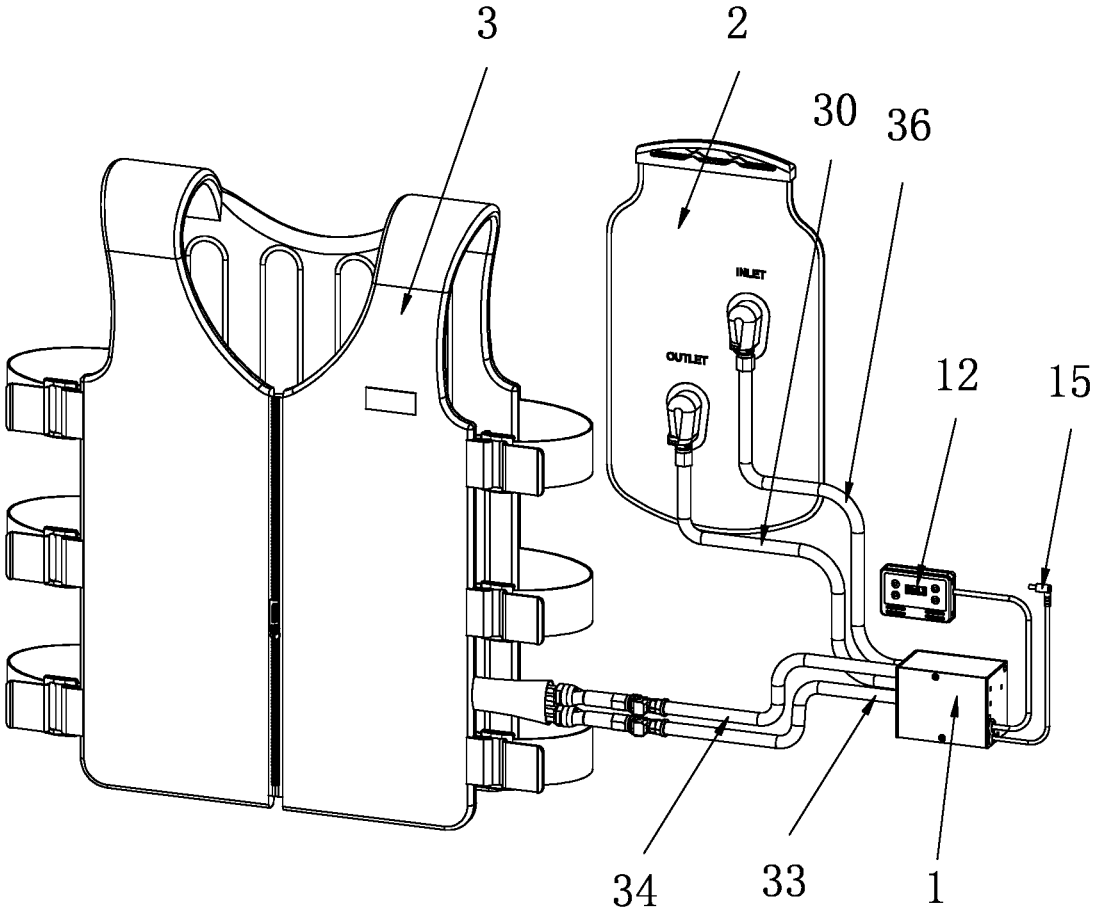
FIG. 10 is a schematic diagram of actual use of an embodiment of the present disclosure.
Figure 11:
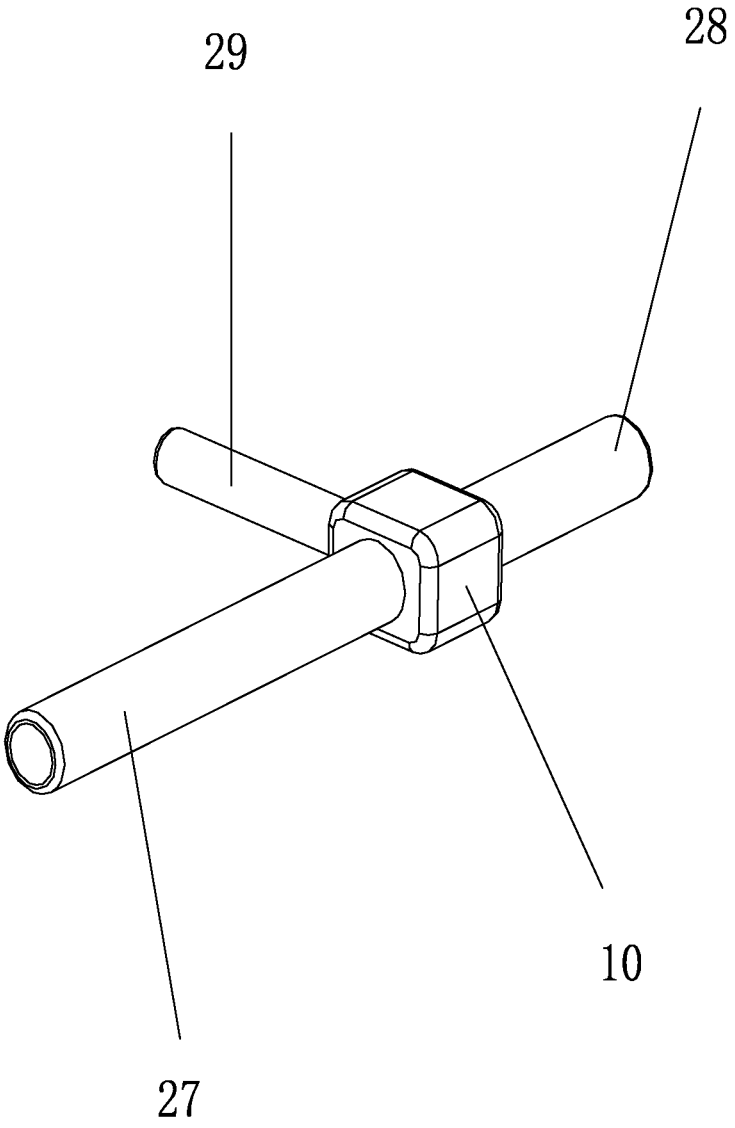
FIG. 11 is a schematic structural diagram of a flow division device according to an embodiment of the present disclosure.

Further, the main control panel 8 of this embodiment is provided with an MCU chip 16, a first drive circuit 17, and a second drive circuit 18. The operation apparatus 12 is internally provided with an auxiliary control panel 19 (as shown in FIG. 3). The power supply 15 supplies power to the MCU chip 16. The auxiliary control panel 19 is provided with a display device 20, a nixie tube drive chip 21, and several buttons 22 for operation. The MCU chip 16 sends a signal and drives the first water pump 6 and the second water pump 7 to rotate and run through the first drive circuit 17 and the second drive circuit 18 respectively. The temperature sensor 11 is electrically connected to the MCU chip 16 and uploads a measured temperature signal of the water tank 5 to the MCU chip 16. The nixie tube drive chip 21 is electrically connected to a first indicator lamp circuit 23 and a second indicator lamp circuit 24 (as shown in FIG. 3). A circuit (as shown in FIG. 7) and buttons 22 of the display device 20 are electrically connected to the nixie tube drive chip 21 respectively. The MCU chip 16 is electrically connected to a third indicator circuit 25 (as shown in FIG. 3). The MCU chip 16 outputs different voltage values through the first drive circuit 17 and the second drive circuit 18 in a manner of converting a digital signal to an analog signal, and drives the first water pump 6 and the second water pump 7 to generate different rotation speeds. A user sets a temperature required by the liquid cooling vest 3 through the button 22 and drives the display device 20 to implement displaying through the nixie tube drive chip 21. The MCU chip 16 determines the rotation speed of the first water pump 6 according to a difference value between a set temperature and an actual temperature of liquid in the water tank 5. When the actual temperature of the liquid in the water tank 5 is the same as or close to the set temperature, the first water pump 6 rotates at a reduced speed, and the second water pump 7 rotates and runs at a constant speed and pumps the liquid from the water tank 5 to the circulating water path 14 in the liquid cooling vest 3. An indicator lamp in the first indicator lamp circuit 23 is used for indicating an on state, and an indicator lamp in the second indicator lamp circuit 24 is used for indicating running modes or states of the first water pump 6 and the second water pump 7. An indicator lamp in the third indicator lamp circuit 25 is used for indicating a running state of the temperature controller 1. There are at least four buttons 22. The buttons 22 have functions of on-off control, water pump control, increase setting of the preset temperature of the operation apparatus 12, and decrease setting of the preset temperature of the operation apparatus 12.

Figure 6:
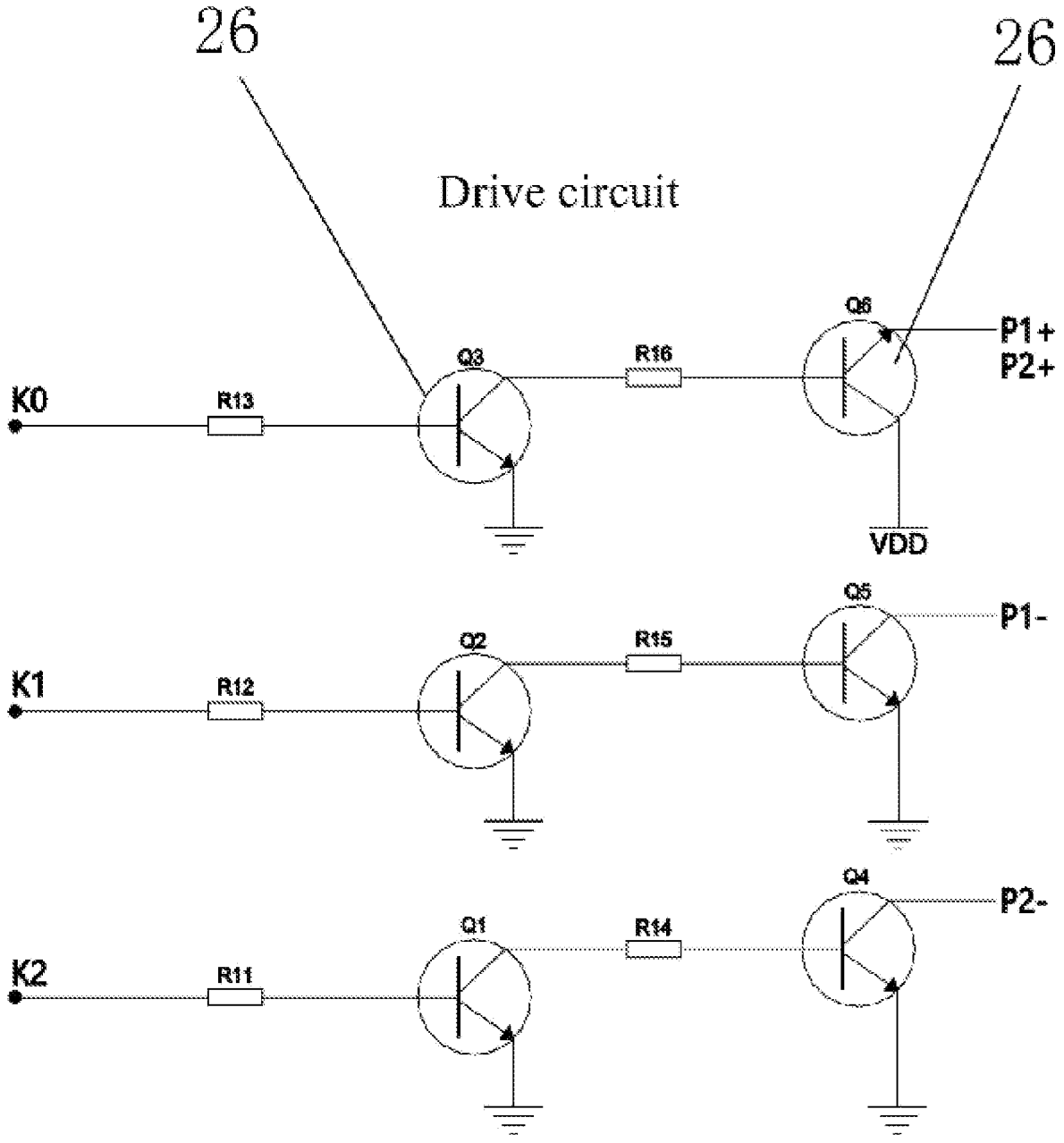
FIG. 6 is a circuit diagram of a first drive circuit and a second drive circuit according to an embodiment of the present disclosure.

Further, the first drive circuit 17 and the second drive circuit 18 of this embodiment are as shown in FIG. 6. The first drive circuit 17 and the second drive circuit 18 drive the first water pump 6 and the second water pump 7 to rotate and run through a triode 26 in FIG. 6. An intelligent analysis software system is installed in the MCU chip, and makes intelligent analysis through internal software by means of receiving an external input instruction and receiving the signal of the temperature sensor. The MCU chip outputs, according to an intelligent analysis result, different voltage values to the first drive circuit 17 and the second drive circuit 18 in the manner of converting a digital signal to an analog signal, and drives start, stop and different rotation speeds of the first water pump 6 and the second water pump 7, thus outputting different liquid flow rates. The device generally achieves precise temperature control through an analog-digital-analog control mode.

During actual operation of this embodiment, first, a user wears the liquid cooling vest 3. The water in the cold source container 2 is put in a refrigerator to make the internal water completely iced up. The liquid cooling vest 3 is connected to the cold source container 2 through a pipeline (the pipeline refers to any pipeline in FIG. 2) to form the run-through circulating water path 14. Second, the user operates the corresponding button 22 to turn on the device. The power supply 15 supplies power to the main control panel 8 and the auxiliary control panel 19. The user sets a desired temperature through the button 22, and the desired temperature is displayed on the display device 20 through the nixie tube drive chip 21. The temperature sensor 11 uploads a temperature signal to the MCU chip 16. The MCU chip 16 sends a signal and drives the first water pump 6 and the second water pump 7 to run through the first drive circuit 17 and the second drive circuit 18. The MCU chip 16 determines the rotation speed of the first water pump 6 according to the difference value between the set temperature and the actual temperature of liquid in the water tank 5. Meanwhile, the first water pump 6 enables the liquid in the water tank 5 to flow through a channel in the cold source container 2 through a pipeline, so that the liquid flowing through the cold source container 2 contacts the liquid in the cold source container 2 for heat exchange. The temperature of the liquid flowing out of the cold source container 2 decreases, and the liquid is pumped into the water tank 5 again. When the actual temperature of the liquid in the water tank 5 is the same as or close to the set temperature, the first water pump 6 rotates at the reduced speed, and the second water pump 7 rotates and runs at the constant speed and pumps the liquid from the water tank 5 to the circulating water path 14 in the liquid cooling vest 3. Therefore, the temperature of the liquid in the water tank 5 can be precisely controlled, and the temperature of the circulating water path 14 in the liquid cooling vest 3 is also indirectly precisely controlled. The temperature controller 1 adjusts the temperature of the circulating water path 14 according to the temperature inside the liquid cooling vest 3, so that the temperature inside the liquid cooling vest 3 is kept within a temperature range preset by the operation apparatus 12. Thus, the temperature control precision in the liquid cooling vest 3 is greatly improved. A user wearing the liquid cooling vest 3 feels little body temperature change and very comfortable. The liquid cooling vest 3 can also replace a liquid cooling carpet for use by the user.

Meanwhile, many fluid circulation units on the market use fans or compressors or semiconductor chilling plates for cooling. They have a complex structure, need a battery or a power supply, are inconvenient to move, large in size and weight, high in energy consumption and expensive, and also has a high fault rate, resulting in high use cost and poor use effect for users. In this device, liquid flows through the cold source container 2 to cool the water in the water tank 5. The main control panel 8 can control the rotation speeds of the first water pump 6 and the second water pump 7 according to the difference value between the preset temperature and the actual temperature of the liquid in the water tank 5. Constant-temperature use of the liquid cooling vest 3 can be achieved by precisely controlling the temperature of the liquid in the water tank 5, which effectively improves the comfort level of the user. The working principle of the entire device is simple. When the user uses the device, the water in the cold source container 2 is put in the refrigerator to make the internal water completely iced up for cooling. After the ice in the cold source container 2 absorbs heat and is molten into water, the user can put the cold source container 2 in the refrigerator for freezing for cooling use again. Therefore, the user has low use cost and works reliably, which greatly meets the actual use needs of the user.

Further, the cold source container 2 of this embodiment is a bag body or a thermal insulation case body internally provided with a cold source body 13 and having a thermal insulation function, and the cold source body 13 is ice or liquid nitrogen or the like. Therefore, when the first water pump 6 pumps the liquid from the water tank 5 through the cold source body 13 in the cold source container 2 through the pipeline, the temperature of the liquid pumped into the water tank 5 again decreases. The second water pump 7 pumps the cryogenic liquid from the water tank 5 to the circulating water path 14 in the liquid cooling vest 3. The liquid cooling vest 3 is worn inside. The cryogenic liquid exchanges heat with the user through continuous circulation to take away the heat generated by the body of the user.

Further, outer surfaces or inner walls of the water tank 5, the first pipeline 30, the second pipeline 31, the third pipeline 32, the fourth pipeline 33, the fifth pipeline 32, the sixth pipeline 33, the seventh pipeline 34 and the cold source container 2 of this embodiment are all provided with thermal insulation layers (not shown in the figure). The thermal insulation layer is made of polyurethane foam or aero gel or the like, so the thermal insulation layer has the functions of heat preservation and heat insulation. By the arrangement of the thermal insulation layer, the temperatures in the water tank 5, the pipelines and the cold source container 2 will not be subjected to heat exchange with the external temperature, so as to prevent heat loss and effectively improve the heat exchange efficiency of the device.

Further, the first water pump 6 in this embodiment is a centrifugal pump or a diaphragm pump, and the second water pump 7 is a diaphragm pump. A diaphragm pump has a high negative pressure suction force, so the second water pump 7 can pump the cryogenic liquid in the cold source container 2 to the water tank 5 through a fluid pressure. The first water pump 6 pumps out the constant-temperature liquid in the water tank 5 and injects it into the circulation pipeline in the liquid cooling vest 3 to achieved closed cooling circulation.

Further, the temperature sensor 11 in this embodiment is a digital temperature sensor 11. The digital temperature sensor 11 is a sensor that can convert, through a temperature sensing element and a corresponding circuit, a physical quantity of temperature into a digital quantity that can be directly read by a computer, a PLC, an intelligent instrument and other sets of data acquisition equipment. The digital temperature sensor 11 has the advantages of high temperature measurement accuracy and large temperature measurement range, which is convenient for the actual use of the device. A signal connector of the temperature sensor 11 needs to be electrically connected with the main control panel 8. A sensing head of the temperature sensor 11 needs to be fixedly arranged inside the water tank 5 and in contact with the liquid in the water tank 5 to sense the temperature of the liquid.

Further, the display device 20 of this embodiment is a display screen, a light emitting diode (LED) nixie tube, an LED lamp matrix, and the like. The display device 20 of this embodiment uses the LED nixie tube. The LED nixie tube has the advantages of low cost and easy procurement, and a user can directly view a temperature.

Further, the MCU chip 16 in this embodiment is chip PIC16F1825, and the nixie tube drive chip 21 is chip TM1650. Chip PIC16F1825 has the advantages of stable performance and low power consumption.

Further, an inner diameter of the backflow port 29 of the flow division device 10 of this embodiment is smaller than the inner diameters of the primary flow division port 27 and the secondary flow division port 28. Therefore, different ports of the flow division device 10 constitute a mechanical pressure flow division device 10. The inner diameter of the backflow port 29 is smaller than the inner diameters of the primary flow division port 27 and the secondary flow division port 28. Therefore, when the liquid flows through the backflow port 29, the primary flow division port 27 and the secondary flow division port 28, a pressure in the backflow port 29 is relatively high, which forms a pressure difference. The liquid in the backflow port 29 is injected into the cold source container 2 through the seventh pipeline 36, and the liquid at the water outlet of the second water pump 7 enters the water tank 5 through the fourth pipeline 33, the liquid cooling vest 3, the fifth pipeline 34, the primary flow division port 27 and the secondary flow division port 28 in sequence. The liquid in the water tank 5 then enters the water inlet of the second water pump 7 through the fourth pipeline 33 to form the circulating water path 14. At the same time, the water inlet of the first water pump 6 pumps the liquid at the backflow port 29 through the seventh pipeline 36, the cold source container 2 and the fourth pipeline 33 in sequence. The water outlet of the first water pump 6 injects the liquid into the water tank 5 through the second pipeline 31 to form another circulating water path 14. The device repeats the above circulating water paths 14 during actual operation.

Further, the main control panel of this embodiment is provided with a communication interface 37 for connecting a Bluetooth module (not shown in the figure), a WiFi module (not shown in the figure), and an external human vital sign monitoring module (not shown in the figure). Therefore, the device can receive instruction signal inputs from the Bluetooth module, the WiFi module and the external human vital sign monitoring module through the communication interface 37, thereby intelligently controlling the temperature of the liquid cooling vest 3, and can perform intelligent control to enter a rescue or protection mode.

As shown in FIG. 1 to FIG. 11, a precise temperature control method for a fluid circulation unit provided in this embodiment includes the following steps:

S1. a user wears the liquid cooling vest 3, and presets a desired temperature of the liquid cooling vest 3 using the operation apparatus 12; the temperature sensor 11 transmits an actual temperature signal of the liquid in the water tank 5 to the main control panel 8;

S2. the first water pump 6 pumps out cryogenic liquid in the cold source container 2 through the first pipeline 30 into the water tank 5, thereby reducing the temperature of the liquid in the water tank 5; the main control panel 8 determines a numerical value of the rotation speed of the first water pump 6 according to a difference value between the temperature preset by the operation apparatus 12 and the actual temperature of the liquid in the water tank 5, and the difference value in the temperature is in direct proportion to the rotation speed of the first water pump 6;

S3. when the actual temperature, measured by the temperature sensor 11, of the liquid in the water tank 5 reaches the temperature preset by the operation apparatus 12, the main control panel 8 controls the first water pump 6 to run at a low speed, and the main control panel 8 controls the second water pump 7 to run at a constant speed and pumps the cryogenic liquid in the water tank 5 into the circulating water path 14 in the liquid cooling vest 3;

S4. the liquid in the circulating water path 14 in the liquid cooling vest 3 contacts heat of the body of the user to achieve a temperature rise in the liquid in the circulating water path 14 in the liquid cooling vest 3, and at the same time, the liquid in the circulating water path in the liquid cooling vest 3 flows back to the water tank 5 through the fifth pipeline 34, the flow division device 10 and the sixth pipeline 35;

S5. after use for a period of time, the liquid in the circulating water path 14 of the liquid cooling vest 3 has a temperature rise and flows back to the water tank 5, so that the temperature of the liquid in the water tank 5 rises; the main control panel 8 may control the rotation speed of the first water pump 6 according to the difference value between the temperature preset by the operation apparatus 12 and an actual temperature rise or drop of the liquid in the water tank 5; steps S2 and S3 are repeated until the temperature of the liquid in the water tank 5 reaches the preset temperature of the operation apparatus 12 to precisely control the range of temperature fluctuation of the liquid in the water tank 5, so that the second water pump 7 pumps the constant-temperature liquid in the water tank 5 to the circulating water path 14 in the liquid cooling vest 3 to precisely control the temperature of the liquid in the circulating water path 14 in the liquid cooling vest 3.

Further, the temperature range that can be set by the operation apparatus 12 in this embodiment is 0 to 30. The optimum temperature for a human body is 20-22. However, people in different ages, genders, physical conditions and activity statuses require different temperatures. According to the use and demands of different people, by the precise temperature control device for the fluid circulation unit in the implementation of the present disclosure can be set by users independently, so as to meet the cooling needs of all kinds of people.

The above descriptions are only the preferred embodiments of the present disclosure, and are not intended to limit the scope of the present disclosure. Any equivalent structure or equivalent process transformation made by using the content of the description and drawings of the present disclosure and directly or indirectly applied to other related technical fields shall all be similarly included in the scope of patent protection of the present disclosure.

What is claimed is:

1. A precise temperature control device for a fluid circulation unit, comprising:

a temperature controller;

a cold source container; and a liquid cooling vest for water circulation heat exchange;

wherein the temperature controller comprises:

a shell;

a water tank arranged in the shell;

a flow division device with a flow division function;

a first water pump;

a second water pump; and a main control panel;

wherein, the main control panel is electrically connected to an operation apparatus for setting a temperature;

the flow division device is provided with a primary flow division port, a secondary flow division port, and a backflow port which are interconnected;

a water inlet of the first water pump is connected to the cold source container through a first pipeline, and a water outlet of the first water pump is connected to the water tank through a second pipeline;

a water inlet of the second water pump is connected to the water tank through a third pipeline, and a water outlet of the second water pump is connected to a water inlet of the liquid cooling vest through a fourth pipeline;

a water outlet of the liquid cooling vest is connected to the water tank through a fifth pipeline, the primary flow division port and the secondary flow division port of the flow division device and a sixth pipeline in sequence;

the backflow port of the flow division device is connected to the cold source container through a seventh pipeline;

the water tank is provided with a temperature sensor; wherein the temperature sensor, the first water pump and the second water pump are electrically connected to the main control panel; the water tank is filled with liquid; and the temperature controller forms a cold-heat adjustable circulating water path with the cold source container and the liquid cooling vest through the first through seventh pipelines; and the main control panel is connected to a power supply and controls the system to work in order.

2. The precise temperature control device for the fluid circulation unit according to claim 1, wherein the main control panel is provided with a micro control unit (MCU) chip, a first drive circuit, and a second drive circuit; the operation apparatus is internally provided with an auxiliary control panel; the power supply supplies power to the MCU chip; the auxiliary control panel is provided with a display device and a nixie tube drive chip;

wherein, the MCU chip sends a signal and drives the first water pump and the second water pump to rotate and run through the first drive circuit and the second drive circuit respectively;

the temperature sensor is electrically connected to the MCU chip and uploads a measured temperature signal of the water tank to the MCU chip;

the nixie tube drive chip is electrically connected to a first indicator lamp circuit and a second indicator lamp circuit, a circuit and a button of the display device are electrically connected to the nixie tube drive chip respectively; and the MCU chip is electrically connected to a third indicator circuit; the MCU chip outputs different voltage values through the first drive circuit and the second drive circuit in a manner of converting a digital signal to an analog signal, and drives the first water pump and the second water pump to generate different rotation speeds; a temperature required by the liquid cooling vest is set through the button and the display device is driven to implement displaying through the nixie tube drive chip; the MCU chip determines the rotation speed of the first water pump according to a difference value between a set temperature and an actual temperature of liquid in the water tank; when the actual temperature of the liquid in the water tank is the same as the set temperature, the first water pump rotates at a reduced speed, and the second water pump rotates and runs at a constant speed and pumps the liquid from the water tank to the circulating water path in the liquid cooling vest.

3. The precise temperature control device for the fluid circulation unit according to claim 1, wherein the cold source container is a bag body or a thermal insulation case body internally provided with a cold source body, and the cold source body is ice.

4. The precise temperature control device for the fluid circulation unit according to claim 1, wherein outer surfaces or inner walls of the water tank, the first pipeline, the second pipeline, the third pipeline, the fourth pipeline, the fifth pipeline, the sixth pipeline, the seventh pipeline and the cold source container are all provided with thermal insulation layers.

5. The precise temperature control device for the fluid circulation unit according to claim 1, wherein the first water pump is a centrifugal pump, and the second water pump is a diaphragm pump.

6. The precise temperature control device for the fluid circulation unit according to claim 1, wherein an inner diameter of the backflow port of the flow division device is smaller than the inner diameters of the primary flow division port and the secondary flow division port.

7. The precise temperature control device for the fluid circulation unit according to claim 2, wherein the MCU chip is chip PIC16F1825, and the nixie tube drive chip is chip TM1650.

8. The precise temperature control device for the fluid circulation unit according to claim 1, wherein the main control panel is provided with a communication interface for connecting a Bluetooth module, a WiFi module and an external human vital sign monitoring module.

9. A precise temperature control method for the fluid circulation unit according to claim 1, comprising the following steps:

S1. a user wears the liquid cooling vest, and presets a desired temperature of the liquid cooling vest using the operation apparatus, and at the same time, the temperature sensor transmits an actual temperature signal of the liquid in the water tank to the main control panel;

S2. the first water pump pumps cryogenic liquid out from the cold source container through the first pipeline to the water tank, thereby reducing the temperature of the liquid in the water tank; the main control panel determines a numerical value of the rotation speed of the first water pump according to a difference value between the temperature preset by the operation apparatus and the actual temperature of the liquid in the water tank, and the difference value in the temperature is in direct proportion to the rotation speed of the first water pump;

S3. when the actual temperature, measured by the temperature sensor, of the liquid in the water tank reaches the temperature preset by the operation apparatus, the main control panel controls the first water pump to run at a low speed, and the main control panel controls the second water pump to run at a constant speed and pumps the cryogenic liquid from the water tank to the circulating water path in the liquid cooling vest;

S4. the liquid in the circulating water path in the liquid cooling vest contacts heat of the body of the user to achieve a temperature rise in the liquid in the circulating water path in the liquid cooling vest, and at the same time, the liquid in the circulating water path in the liquid cooling vest flows back to the water tank through the fifth pipeline, the flow division device and the sixth pipeline;

S5. after the user uses the liquid cooling vest for a period of time, the liquid in the circulating water path of the liquid cooling vest has a temperature rise and flows back to the water tank, so that the temperature of the liquid in the water tank rises; the main control panel controls the rotation speed of the first water pump according to the difference value between the temperature preset by the operation apparatus and an actual temperature rise or drop of the liquid in the water tank;

wherein steps S2 and S3 are repeated until the temperature of the liquid in the water tank reaches the preset temperature of the operation apparatus, so that the second water pump pumps the constant-temperature liquid from the water tank to the circulating water path in the liquid cooling vest to keep the liquid in the circulating water path in the liquid cooling vest constant.

* * * * *